US009102507B2

(12) United States Patent
Willim

(10) Patent No.: US 9,102,507 B2
(45) Date of Patent: Aug. 11, 2015

(54) METHOD OF OPERATING A CRANE AND CRANE

(75) Inventor: Hans-Dieter Willim, Ulm-Unterweiler (DE)

(73) Assignee: LIEBHERR-WERK EHINGEN GMBH, Ehingen/Donau (DE)

( * ) Notice: Subject to any disclaimer, the term of this patent is extended or adjusted under 35 U.S.C. 154(b) by 107 days.

(21) Appl. No.: 13/535,472

(22) Filed: Jun. 28, 2012

(65) Prior Publication Data

US 2013/0001182 A1 Jan. 3, 2013

(30) Foreign Application Priority Data

Jun. 29, 2011 (DE) ..... 10 2011 105 960
Feb. 2, 2012 (DE) ..... 10 2012 002 040

(51) Int. Cl.
*B66C 23/76* (2006.01)

(52) U.S. Cl.
CPC ..... *B66C 23/76* (2013.01)

(58) Field of Classification Search
USPC ..... 212/223, 276, 279, 284, 195, 196, 198, 212/270, 290
See application file for complete search history.

(56) References Cited

U.S. PATENT DOCUMENTS

| | | | | | |
|---|---|---|---|---|---|
| 3,836,010 | A * | 9/1974 | Lampson | 212/195 |
| 3,842,984 | A * | 10/1974 | Brown et al. | 212/195 |
| 4,258,852 | A * | 3/1981 | Juergens | 212/178 |
| 4,349,115 | A * | 9/1982 | Lampson | 212/178 |
| 4,358,021 | A * | 11/1982 | Helm et al. | 212/195 |
| 4,449,635 | A * | 5/1984 | Helm et al. | 212/196 |
| 4,498,596 | A * | 2/1985 | Haulotte | 212/306 |
| 4,540,097 | A * | 9/1985 | Wadsworth et al. | 212/196 |
| 4,557,390 | A * | 12/1985 | Mick | 212/197 |
| 4,601,402 | A * | 7/1986 | Helm et al. | 212/301 |
| 4,614,275 | A * | 9/1986 | Zenno | 212/198 |
| 5,199,583 | A * | 4/1993 | Weider et al. | 212/279 |
| 6,283,315 | B1 * | 9/2001 | Willim et al. | 212/196 |
| 6,568,547 | B1 * | 5/2003 | Kretschmer et al. | 212/196 |
| 7,331,476 | B2 * | 2/2008 | Yerly | 212/196 |
| 8,528,755 | B2 * | 9/2013 | Kurotsu | 212/196 |
| 2011/0017694 | A1 * | 1/2011 | Noske et al. | 212/276 |
| 2011/0049075 | A1 * | 3/2011 | Willim | 212/279 |
| 2013/0001182 | A1 | 1/2013 | Willim | |
| 2013/0105429 | A1 * | 5/2013 | Kakeya et al. | 212/279 |

FOREIGN PATENT DOCUMENTS

| | | |
|---|---|---|
| DE | 2438439 | 2/1976 |
| DE | 3019220 | 12/1980 |
| DE | 3215863 | 12/1982 |
| DE | 20314503 | 1/2005 |
| DE | 10 2011 105 960 A1 | 1/2013 |

* cited by examiner

*Primary Examiner* — Sang Kim
*Assistant Examiner* — Justin Stefanon
(74) *Attorney, Agent, or Firm* — Dilworth & Barrese, LLP

(57) ABSTRACT

The present invention relates to a method of operating a crane having a movable undercarriage and a superstructure rotatably supported thereon with a luffable main boom and derrick boom arranged thereon, wherein an auxiliary crane having a telescopic boom is connected to the crane as derrick ballast and the derrick ballast radius is set via the telescopic boom of the auxiliary crane.

23 Claims, 6 Drawing Sheets

METHOD OF OPERATING A CRANE AND CRANE

BACKGROUND OF THE INVENTION

The invention relates to a method of operating a crane having a movable undercarriage and a superstructure rotatably supported thereon with a luffable main boom and derrick boom arranged thereon.

Large cranes, in particular large crawler-mounted cranes, require a considerable counter-weight which counteracts the raised payload and prevents the tilting of the crane. This counter-weight can be applied by a central ballast, by a superstructure ballast or also by a ballast at the derrick boom. As a rule, a ballast plate supported with respect to the ground via corresponding auxiliary means to take up the ballast is proposed as a possible derrick ballast. A completely suspended ballast or also a derrick ballast carried by a ballast box is possible as an alternative.

Against this background special ballast boxes have been developed which are designed as independently driven vehicles and can therefore be moved together with the crane to ensure a largely unrestricted crane operation. Such solutions, however, always require a complex separate development of a suitable ballast box which is used only for the ballast application. Furthermore, such a ballast box has to be transported separately onto the construction site for the crane use, which his a disadvantegeous effect on the deployment costs incurred since they depend as a rule on the required ballast mass.

A further problem for the dimensioning at the required ballast presents itself on the erecting of long boom combinations. The boom disposed on the ground has a comparatively are lever arm and therefore induces a comparatively large load torque which far exceeds the load torques occurring later during the crane operation. DE 203 14 503 U1 therefore suggests as a solution to bypass this problem to arrange the auxiliary crane required for the equipping process as additional ballast at the superstructure of the crane to be able to compensate the load torques arising during the erection procedure. It is, however, disadvantageous proposed method that the auxiliary crane operating as ballast can only be used during the erection since it would greatly impair the freedom of movement of the crane during the crane work.

SUMMARY OF THE INVENTION

It is the object of the present invention to disclose a new method of operating such crane to be able to overcome the aforesaid problems.

This object is achieved by a method of operating a crane having the features herein. Advantageous embodiments of the method are also the subject herein.

The subject of the invention is accordingly an operating method for a crane having a movable undercarriage and a superstructure rotatably supported thereon, wherein the superstructure is preferably rotatably supported about a vertical axis of rotation with respect to the undercarriage. A main boom which is preferably luffable about a horizontal axis is provided at the superstructure of the crane. A crane in accordance with a known derrick configuration is present for the carrying out of the method so that a derrick boom is likewise pivotally connected to the superstructure.

Provision is made in accordance with the invention that an auxiliary crane having a telescopic boom is connected to the crane as derrick ballast. This ballast application possibility can be used, for example, during regular crane deployment or already during the crane equipping process, especially during the erection process of the main boom of the crane.

A comparatively small crane required for the equipping process of the crane in accordance with the invention is called an auxiliary crane, for example. An auxiliary crane designed as a mobile crane or also as a crawler-mounted crane is in particular suitable.

The auxiliary crane used as derrick ballast is, however, not absolutely responsible for the equipping process of the crane in accordance with the invention. The auxiliary crane can preferably likewise be used as a second crane to turn around the elements of the tower of a wind turbine. The auxiliary crane can furthermore also be used in the moving of the large crane. It can thus be attached to the outer end of the main boom of the crane when the main boom of the crane is lulled down. Both cranes can be moved together as a unit in this manner.

The auxiliary crane used as derrick ballast has the advantage, over a conventional derrick ballast that it can be moved independently on the construction site, whereby the required transfer times of the total crane system from one deployment site to the next deployment site on the construction site can be considerably shortened.

The total weight of the auxiliary crane generally acts as derrick ballast. The telescopic boom system of the auxiliary crane opens up the possibility of adapting the elective derrick ballast weight to the load to be raised since the counter-torque for the crane generated by the auxiliary crane weight is determined via the telescopic length of the auxiliary crane. It proves to be of advantage, for example, to set a small telescopic length when load is taken up by a boom standing comparatively steep. The larger the load or the more shallow the luffing angle of the boom, the larger the extended telescopic length of auxiliary crane boom should be defined. The high load torques engaging during the erection of the boom system can in particular be easily compensated by the auxiliary crane used as derrick ballast and having a suitable boom length.

The auxiliary crane is not only used as derrick ballast during the erection of the luffable main boom of the crane, but should furthermore also be available as derrick ballast during the subsequent crane work. In this respect, the freedom of movement of the crane during the crane work may not be restricted, or may only be insignificantly restricted, by the derrick ballast. For this purpose, in an advantageous embodiment of the invention, provision is now made that a crane control controls at least one drive of the auxiliary crane used as derrick ballast in dependence on the travel movement of the crane. The implementation of the suitable crane control can in this respect preferably be provided on the crane side. The implementation of a suitable crane control can naturally take place without restriction on the side of the auxiliary crane. What is important in this connection is the required coupling between the two cranes to allow the required influencing of at least one drive of the auxiliary crane. In the following, for reasons of simplicity, only a crane control of the crane is spoken of; however, the following statements apply equally to implementations on the auxiliary crane side.

It is conceivable that the travel drive of the auxiliary crane is controlled via the crane control of the crane. Furthermore, further drives of the auxiliary crane, such as the drive at the luffing ram or other drives, can generally be controlled in dependence on the travel movement of the crane.

The auxiliary crane can furthermore also work as a rotary drive for the superstructure of the crane. In this case, the rotary drive of the crane is released and a rotary movement of the crane superstructure is generated by a travel movement of the auxiliary crane.

In a preferred embodiment of the method, the rotary movement of the crane, in particular the rotary movement of the superstructure with respect to the undercarriage, is also taken into account in addition to the travel movement of the crane for the control of the auxiliary crane. Any further desired crane movement can generally also be taken into account in the control of the auxiliary crane.

The influencing of one or more auxiliary crane drives can provide in accordance with on advantageous embodiment of the invention that the crane control independently determines the corresponding steering center for the auxiliary crane on the rotation or the crane and steers, accelerates or decelerates it independently on the tow travel behind the crane, it is thereby prevented that a high lateral force is introduced by the auxiliary crane acting as derrick ballast on the rotation of the crane. There is equally the possibility to counter the aforesaid problem by the use of the auxiliary crane as a rotary drive for the crane.

So that the auxiliary crane can introduce its mass completely as a counterweight for the crane in accordance with the invention, the assembly of guying between the derrick boom and the auxiliary crane is expedient. The guying can, for example, be connected direct or indirectly to the superstructure of the auxiliary crane via a frame.

Equally, other alternative connection points can also be selected. In this connection, any connection point at the outer section of the pivotal connection piece of the boom of the auxiliary crane is conceivable. A connection region of the guying to the pivotal connection piece of the boom in the region of the luffing ram support has proved a sensible alternative.

It is particularly advantageous if the connection between the crane and the auxiliary crane is established via the boom the auxiliary crane, in particular via the telescopic boom of the auxiliary crane. It is conceivable in this connection that the boom tip of the auxiliary crane is directly or indirectly connected to the crane, in particular to the crane superstructure. A fastening of the boom tip at the ballast receiver of the crane or directly at the ballast is also possible. Alternatively, the auxiliary crane or its boom tip can be fastened to the derrick boom of the crane. This procedure is in particular of advantage when the auxiliary crane should be operated as suspended ballast at the crane.

Furthermore, a connection adapter can be interposed between the boom of the auxiliary crane and the superstructure of the crane. The connection adapter can preferably be mounted directly to the roller head of the boom system of the auxiliary crane while utilizing the anyway present bolting points at the roller head which in standard operation serve the reception of a boom extension. The connection axes of the connection points between the crane and the connection adapter are in particular aligned horizontally so that a degree of freedom about a horizontal axis can be realized. The boom of the auxiliary crane can hereby compensate vertical differences if the corresponding luffing drive or luffing ram is released.

The required control lines for the control of the auxiliary crane, preferably electric and/or hydraulic control lines are preferably conducted, starting from the crane, by means of suitable guide means at the connection adapter in the direction of the auxiliary crane.

It can occur that the total weight of the auxiliary crane used is too light for the ballast radius used and thus no sufficient ballast application of the crane derrick boom can be achieved. Under certain circumstances, a further increase in the ballast radius may not be possible for technical reasons since the maximum telescopic length of the auxiliary crane has already been exploited or the space relationships on the construction site do not offer sufficient scope for a further increase in the ballast radius.

It is expedient in this case to arrange one or more ballast elements, in particular ballast plates, directly or indirectly at the auxiliary crane in order further to increase the resulting ballast weight of the auxiliary crane. If the auxiliary crane is designed as a crawler-mounted crane, these ballast elements or ballast plates are preferably attached to at least one crawler carrier or to both crawler carriers. Under certain circumstances, already present connection points of the crawler carrier can be used for fixing the ballast elements. Such connection points can, for example, be the bolt points of an assembly support of the auxiliary crane designed as a crawler-mounted crane.

A further possibility for fastening the ballast elements or ballast plates to the auxiliary crane is to provide at least one reception frame at the auxiliary crane. One or more ballast plates can be stacked on the at least one reception frame.

If the auxiliary crane is designed as a crawler-mounted crane, at least one reception frame can be fastened, in particular bolted, directly or indirectly to the crawler carrier. For this purpose, already present connection points at the crawler carrier may possibly be usable to provide a sufficient fixing of the reception frame at the auxiliary crane.

It can occur that the auxiliary crane loses contact with the ground due to its fastening and positioning relative to the crane in dependence on the applied load torque at the crane. This can occur in a planned manner, for example, if the auxiliary crane is to be used as suspended ballast, but can also occur unintentionally. At least one measuring arrangement can determine the relative position of the crane in the vertical direction toward the ground for control purposes. It can furthermore be expedient to forward the determined values to is crane control of the crane. If the auxiliary crane has lost contact with the ground completely or at least partly, the crane can also be moved without any direct control of an auxiliary crane drive since the freedom of movement of the crane is not restricted due to the suspended auxiliary crane.

Under these conditions, the auxiliary crane can particularly preferably be used as suspended ballast for the crane derrick boom. It must naturally always be ensured for this deployment case that the auxiliary crane used completely loses the contact with the ground, which checked by an evaluation of the measured values provided by the measuring arrangement.

To determine the actual ballast radius of the acting ballast, at least one measuring arrangement can determine the length of a longitudinally variable connection line between the auxiliary crane and the crane. In the simplest case, the length is determined with the aid of a measuring drum, with the latter being connected to the auxiliary crane, on the one hand, and to the crane, on the other hand. The distance between the pivotal connection piece of the boom of the auxiliary crane and its boom head can in particular be measured.

A direct setting of the longitudinally variable connection line between the auxiliary crane and the crane is conceivable in order actively to promote a raising of the auxiliary crane. A crane control of the crane accordingly evaluates the relative position of the auxiliary crane in the vertical direction toward the ground and configures the longitudinally variable connection line on the basis of the evaluated positional data.

It is not necessary in this case that a residual weight is introduced from the auxiliary crane footprint, in particular from the crawler chassis, into the ground for the moving of the auxiliary crane.

A further aspect of the invention relates to a crane having a movable undercarriage and a superstructure rotatably supported thereon, wherein the latter is preferably rotatably supported about a vertical axis of rotation with respect to the undercarriage. A main boom which is luffable about a horizontal axis is provided at the superstructure of the crane. The crane is designed in accordance with a known derrick configuration and accordingly additionally includes a derrick boom arranged at the superstructure.

Provision is made in accordance with the invention that an auxiliary crane is connectable or connected to the crane as derrick ballast. A comparatively small crane having a telescopic boom, in particular a mobile crane or a crawler-mounted crane, required for the equipping process of the crane in accordance with the invention is called an auxiliary crane, for example. The auxiliary crane used as derrick ballast however, not absolutely responsible for the equipping process of the crane in accordance with the invention.

In addition to the use as derrick ballast for erecting the luffable main boom of the crane in accordance with the invention, it should also be available as derrick ballast for the following crane work. The derrick ballast radius or the effective derrick ballast weight can be set via the telescopic length of the boom system of the auxiliary crane.

In order not to impair the crane's free movement space, the crane preferably has a crane control to control at least one drive of the auxiliary crane used as derrick ballast in dependence on the travel movement of the crane. It is conceivable that the travel drive of the auxiliary crane is controllable via the control of the crane. It is generally conceivable that any desired dives of the auxiliary crane, such as the drive at the luffing ram as well as other drives, are furthermore controllable by means of the crane control.

The crane in particular has the required means for carrying out the method in accordance with the invention in accordance with one of the advantageous embodiments explained above. The advantages and properties of the crane consequently correspond to those of the method in accordance with the invention so that a repeat description will be dispensed with at this point.

The required exchange of control signals between the crane and the auxiliary crane makes a suitable cable guidance necessary. One or more electric and/or hydraulic lines between the crane and the auxiliary crane are expediently laid for influencing one or more drives of the auxiliary crane. For this purpose, at least one guide means or more guide means are provide at connection adapter which serve for receiving one or more lines and provide a sufficiently stable and secure guide possibility.

The invention is moreover directed to a crane system comprising an auxiliary crane as well as a crane in accordance with the invention according to the aforesaid embodiment. The properties and advantages of the crane in accordance with the invention apply equally to the crane system.

It may be sensible to provide especially designed ballast plates which are suitable without restriction for providing ballast selectively at the crane or alternatively at the auxiliary crane. Such ballast plates can be particular be stacked by means of a reception frame at the auxiliary crane.

In an advantageous embodiment of the crane system in accordance with the invention, the auxiliary crane includes at least one sensor for measuring the relative position of the auxiliary crane in the vertical direction toward the ground. Such a sensor can be designed, for example, as a pivotable switch which is supported on the ground, i.e. the footprint of the auxiliary crane. The switch includes at least one sensor system which determines the current pivot position, i.e. the pivot angle, with respect to the ballast or to the reception frame and forwards it as necessary to a control of the crane. The switch pivots outward as soon as the auxiliary crane loses contact with the ground.

In addition, at least one sensor can be provided by means of which the length of a longitudinally variable connection line between the crane and the auxiliary crane can be measured. In the simplest case, a measuring drum is provided either at the auxiliary crane or alternatively at the crane and connects the auxiliary crane to the crane. The measuring drum can, for example, be designed as a rope drum which is attached to the pivotal connection piece of the boom of the auxiliary crane, with the rope end being fastened to the telescopic boom head of the auxiliary crane. The rope extension length defines the distance between the auxiliary crane and the crane, from which the effective ballast radius can be deduced.

The invention further relaters to a connection adapter for the crane in accordance with the invention. The connection adapter forms the suitable coupling element to establish the connection between the auxiliary crane and the crane. The advantages and properties of the connection adapter in accordance with the invention obviously correspond to those of the crane in accordance with the invention. A repeat description is therefore not expedient.

One or more guide means are in particular provided at the connection adapter for guiding one or more electric and/or hydraulic lines. The shape of the connection adapter can be described approximately as a prism with triangular site surfaces, wherein suitable bolting points are available in the corner regions for connection to the auxiliary crane boom and to the crane superstructure.

It is also possible to equip the connection adapter with a corresponding coupling mechanism to ensure a fast and uncomplicated coupling of the aforesaid control lines.

The invention further relates to a crane control for carrying out the method in accordance with the invention, wherein the advantages and properties of the crane control obviously result from the corresponding description of the method in accordance with the invention. The crane control can in this respect selectively be integrated in the auxiliary crane and/or in the main crane. Known cranes can consequently be simply retrofitted, with a coupling of the corresponding control lines additionally having to be observed.

The invention furthermore relates to a data carrier which carries the suitable control software for implementing the aforesaid crane control.

BRIEF DESCRIPTION OF THE DRAWINGS

Further advantages and particulars of the invention will be explained in detail with reference to an embodiment shown in the drawings. There are shown.

DESCRIPTION OF THE PREFERRED EMBODIMENTS

Figure 1:
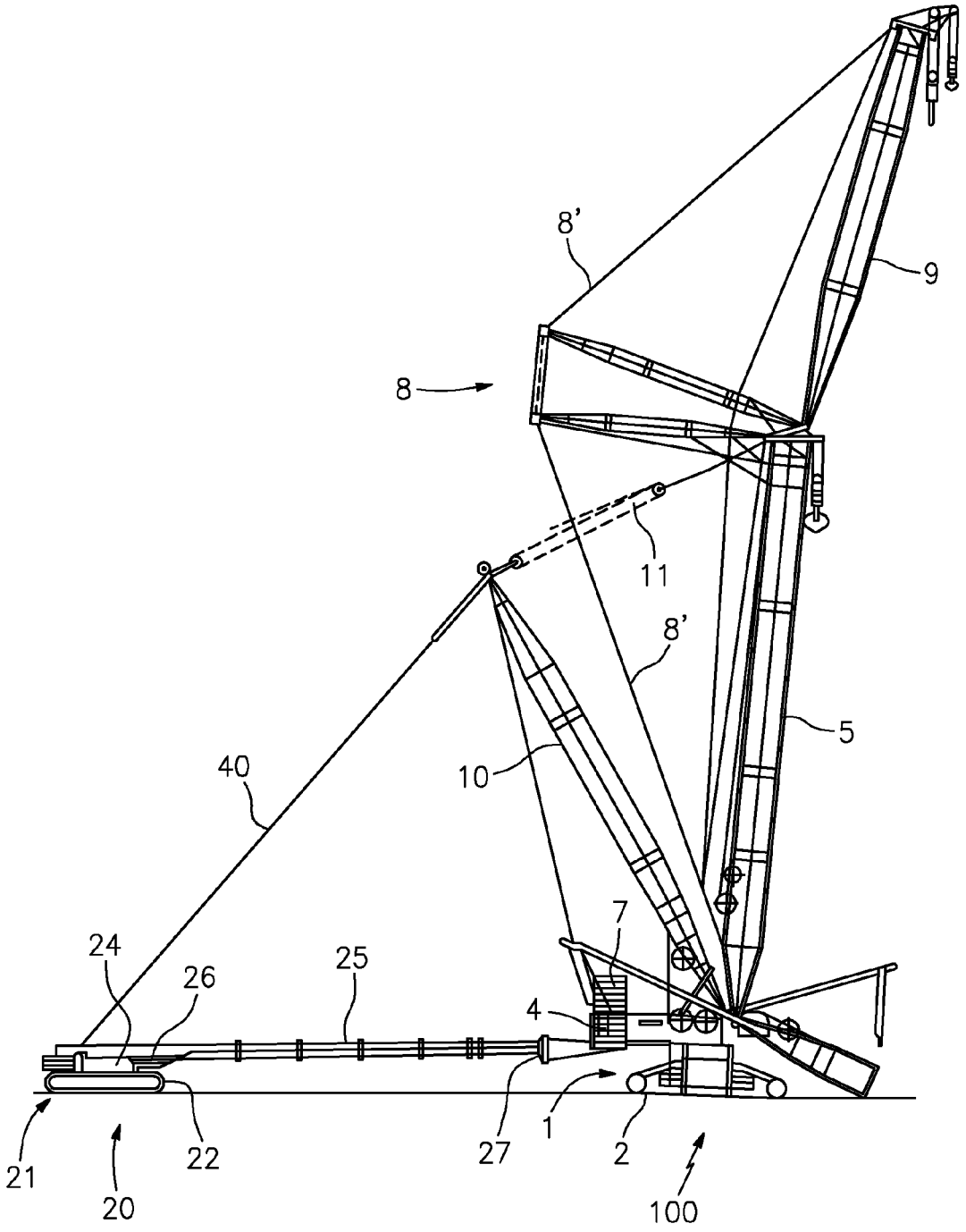
FIG. 1: a side view of the crane in accordance with the invention with a fastened auxiliary crane.

The main crane 100 shown in the Figures has an undercarriage 1 having a chassis 2 which is designed as crawler chassis in the drawn embodiment and comprises two crawler tracks arranged at left and the right. A superstructure 4 rotatably supported about an upright is of rotation is arranged on the undercarriage 1. The superstructure 4 carries a boom 5 which is pivotally connected about a horizontal luffing axis to the superstructure 4 and allows a hoist rope to pay out in a usual manner.

At the rear side of the superstructure 4 opposite the pivotal connection point of the boom the former carries an operating ballast 7 which counteracts the tilting torque induced by the boom 5 or by a load suspended thereon. The luffing fly jib 9 pivotably connected in a luffable manner to the boom 5 can be luffed up and down via the guying 8, 8'.

The rearwardly directed derrick boom 10 is mounted behind the main boom 5, with the main boom 5 or the main boom had being guyed in a known manner via the adjustable guying 11 at the derrick boom 10.

It is necessary on the raising of very heavy loads to guy the derrick boom 10 via an additional derrick ballast. As a rule, a derrick ballast suspended above the ground or a derrick ballast supported with respect to the ground is used for this purpose.

Unlike the prier art, the main crane 100 in accordance with the invention provides an innovative solution approach for the application of ballast to the derrick boom 10. As can recognizably be seen from FIG. 1, instead of a conventional derrick ballast receiver, an available crawler-mounted crane 20 is used which is called an auxiliary crane 20 in the following. The use of the auxiliary crane 20 as derrick ballast has the advantage that the transport of an additional assembly, such as the transport of an additional ballast box or of a ballast plate, is superfluous. The auxiliary crane 20 used as derrick ballast can be traveled independently on the construction site, whereby the required time for transferring the total crane system from one deployment site to the next deployment site on the construction site can be considerably reduced.

The transport costs of the crane 100 to the construction site which are incurred can also be noticeably reduced since an auxiliary crane 20 is anyway present on the construction site to assist as necessary in the equipping process of the crane 100 in accordance with the invention of or to perform any other crane work which arises. The auxiliary crane can, for example, likewise be used as a second crane to turn over the lower elements of a wind turbine. The auxiliary crane can furthermore also be used in the moving of the large crane. It can thus be attached to the outer end of the main boom of the crane when the main boom of the crane is luffed down. Both cranes can be moved together as a unit in this manner.

Any desired crane 20 can generally be used as derrick ballast as long as its physical dimension is sufficiently small with respect to the crane 100.

Figure 2:
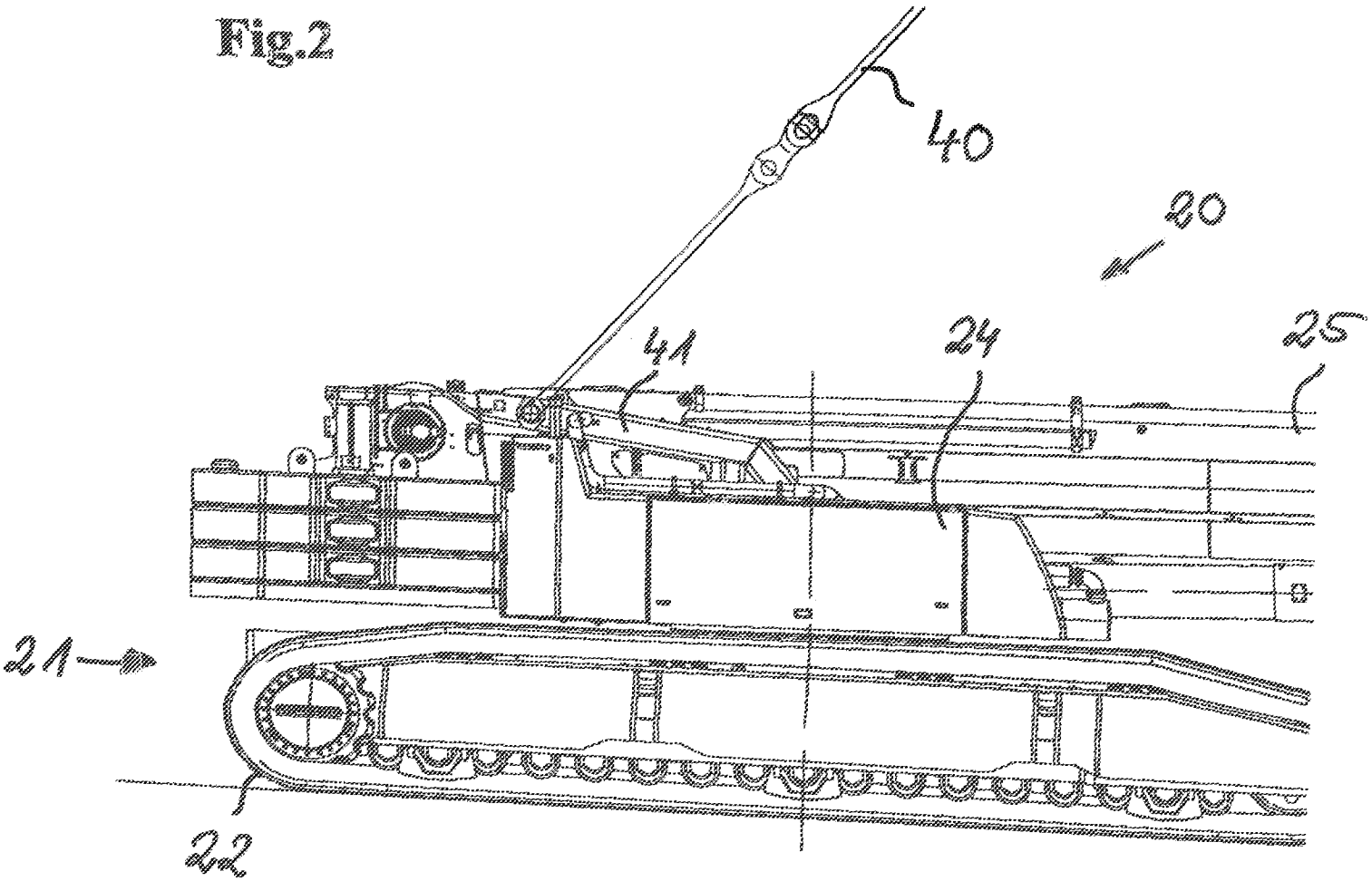
FIG. 2: a detailed view of the superstructure of the auxiliary crane.
Figure 3:
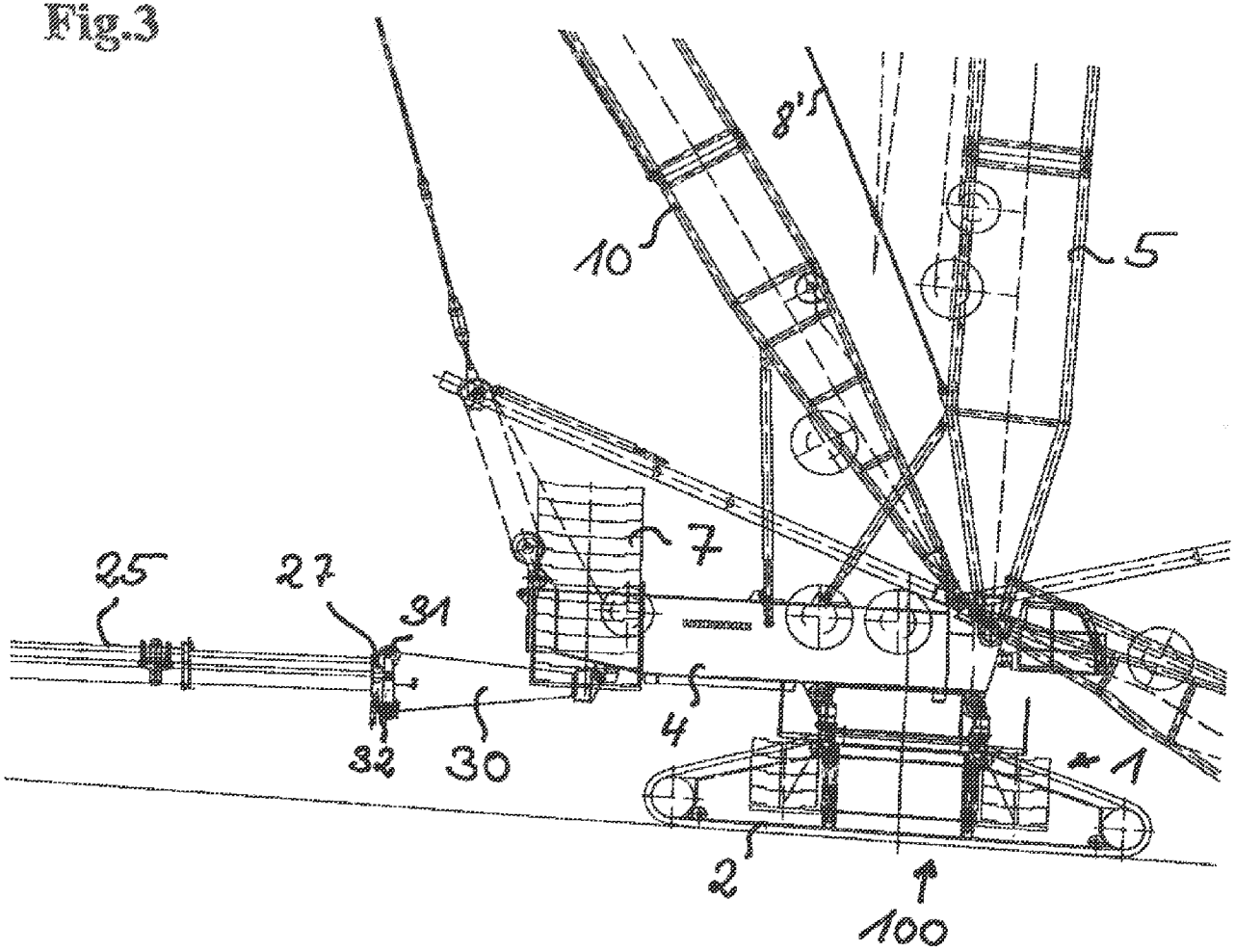
FIG. 3: a detail of the connection point between the auxiliary crane and the crane in accordance with the invention.

In the specific embodiment of FIGS. 1 to 3, the auxiliary crane 20 is likewise designed as a crawler-mounted crane and includes an undercarriage 21 having a crawler chassis 22 carrying two crawler tracks and having a superstructure 24 rotatably supported with respect to the undercarriage 21.

The superstructure 24 carries a boom 25 luffable about a horizontal axis and telescopic. To utilize the auxiliary crane 20 as derrick ballast, its boom 25 is in advance telescoped out to the required boom length and the individual telescopic sections of the boom 25 are bolted accordingly. The telescopic boom 25 is designed as extremely pressure-stable to be able to reach large boom lengths without having to accept an unpermitted increase in the transport weight in so doing.

The telescoped boom length defines the derrick ballast radius of the crane 100 in accordance with the invention. Radii of 45 m or more can be envisaged, for example. Since the auxiliary crane 20 is small in comparison with the crane in accordance with the invention, the required luffed down position of the telescopic boom 25 can be moved to without problem via the crane's own luffing ram 26. Smaller radii can also be moved to depending on the available space on the construction site.

Figure 4:
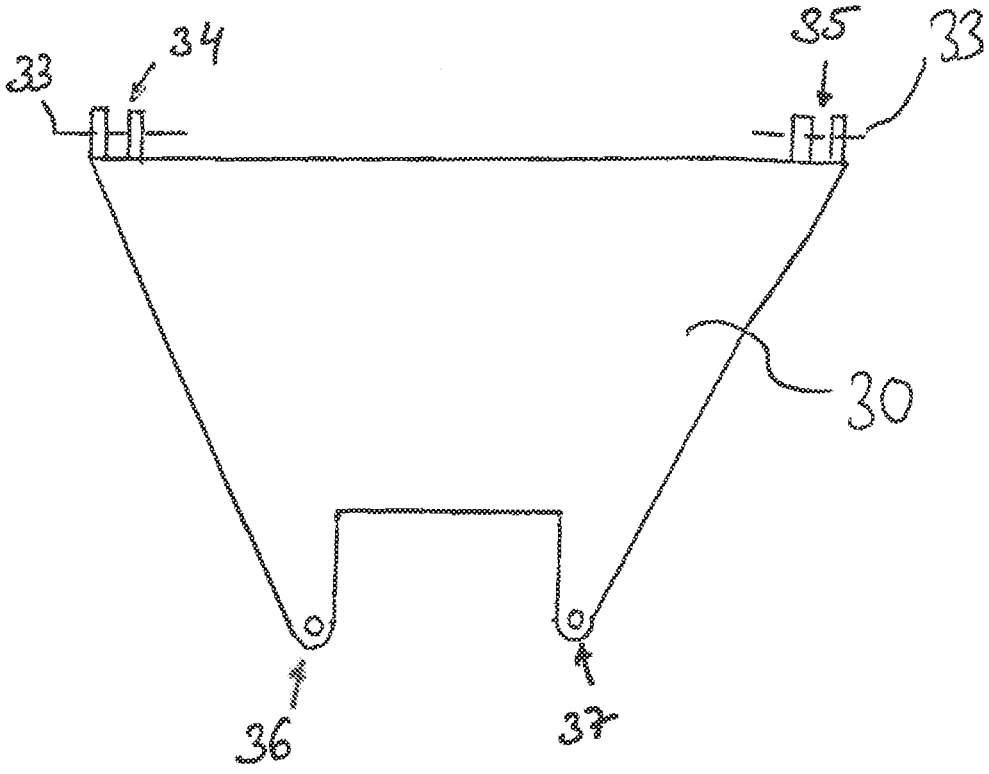
FIG. 4: a plan view of the connection adapter.

The connection adapter 30 is bolted to the tip of the telescopic boom 25 of the auxiliary crane 20, with the bolt points at the roller had 27 of the telescopic boom 25, which are anyway present for the reception of a boom extension, being able to be used. A plan view of the connection adapter can be seen from FIG. 4. The connection adapter 30 is bolted to the bolting points 31, 32 at the roller head 27 via the two adapter connection points 36, 37. The oppositely disposed adapter side can be fastened to the superstructure 4 via the two connection points 34, 35, with the connection axes 33 of the connection points 34, 35 extending horizontally to ensure an additional degree of freedom for compensating vertical differences between the auxiliary crane 20 and the crane 100. The compensation of vertical differences is in particular without problem if the luffing ram 26 of the auxiliary crane 20 is released. A detail of the connection adapter 30 mounted between the auxiliary crane 20 and the superstructure 4 can be seen from FIG. 3.

The guying marked by reference numeral 40 is necessary between the auxiliary crane 20 and the derrick boom 10 so that the auxiliary crane 10 can completely introduce its mass as a counterweight. The guying 40 extends, starting from the tip of the derrick boom 10, in the direction of the auxiliary crane 20 and is bolted to its superstructure 24.

It can be seen from the detail of the superstructure 24 of FIG. 2 that the guying 40 is not directly fastened to the superstructure 24, but is rather bolted on indirectly via the frame pad 41. Alternatively, the guying can be pivotally connected directly or indirectly to the pivotal connection piece of the boom of the auxiliary crane, in particular to the pivotal connection piece of the boom in the region of the luffing ram support or of any other section of the pivotal connection piece of the boom.

It is necessary, to ensure an unrestricted crane operation with an auxiliary crane 20 acting as derrick ballast, that the crane control of the crane 100 obtains influence on the drive or drives of the auxiliary crane 20. It is desirable in this connection that on any crane movement of the crane 100, a correspondingly synchronous control of the individual drives of the auxiliary crane 20 takes place so that the free space of movement of the crane 100 remains unrestricted, it is also possible that the auxiliary crane 20 acts as a rotary drive for the superstructure 4 of the crane 100. In this case, the slewing gear drive of the crane 100 is released so that the travel movement of the auxiliary crane 20 effects a rotary movement of the superstructure 4.

The basic movements of the crane 100 comprise, on the one hand, the rotation of the superstructure 4 and, on the other hand, the towing travel, that is the travel in which the derrick ballast, that is the auxiliary crane 20, follows the crane 100. When carrying out these movements of the crane 100, the drive or drives of the auxiliary crane 20, in particular its travel drive, must therefore be controlled such that unpermitted forces of the auxiliary crane 20 on the crane 100 can be avoided during the crane travel movement.

The required control interface between the crane 100 and the auxiliary crane 20 is formed by one or more electric or also hydraulic control lines which connect corresponding control components of the two cranes 20, 100. The lines extend, starting from the crane 100, via the connection adapter 30 along the longitudinal axis of the boom 25 in the direction of the drives of the auxiliary crane 20 to be controlled. For this purpose, the adapter piece 30 has corresponding guide means which provide reliable receiver and guide possibility for the laid control lines.

The key idea in accordance with the invention can generally also be used with alternative crane types. The crane 100 and/or the auxiliary crane 20 can in particular also be designed as a mobile crane with a wheel chassis.

Figure 5:
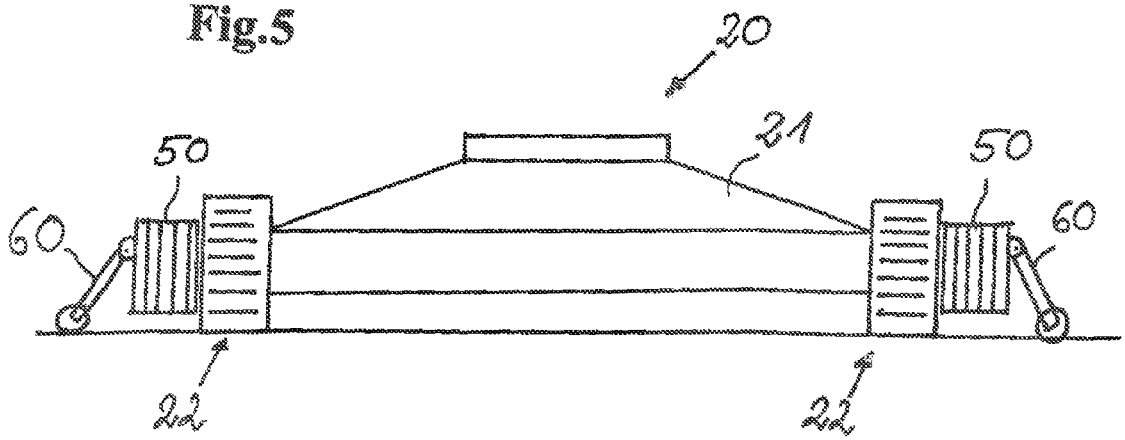
FIG. 5: a detail of the auxiliary crane provided with additional ballast plates.

FIG. 5 shows a detail of the undercarriage 21 of the auxiliary crane 20 used. As in the preceding Figures, the auxiliary crane 20 is designed as a crawler-mounted crane. A plurality of ballast plates 50 are arranged in a string in the direction of the horizontal and are bolted to the respective crawler carrier 22 at each outer surface of the two crawler carriers 22. Existing connection points at the crawler carrier are used as bolting points and usually serve the reception of an installation aid during the equipping process.

In addition, as with the known derrick ballast, at least one switch 60 is provided at each ballast stack 50 which extends at a variable angle from the stack surface of the most outward ballast plate 50 in the direction of the crane footprint.

If the auxiliary crane 20 loses contact with the ground, the switch 60 pivots out downwardly; the switch angle to the ballast stack 50 reduces. A sensor system within the switch 60 reports the switch position to the crane control of the main crane 100. As soon as a loss of ground contact is recognized by the crane control, a rotational movement of the crane 100 can also be released without any corresponding control of the auxiliary crane 20.

It is a general condition for a raising of the auxiliary crane 20 that the load torque of the main crane 100 adopts a specific value or exceeds it. The raising of the auxiliary crane 20 via the configuration of the distance between the auxiliary crane 20 and the crane 100 can be set for the desired use of the auxiliary crane 20 as suspended ballast. In this case, the auxiliary crane 20 is connected to the derrick boom 10 of the crane 100.

Figure 6:
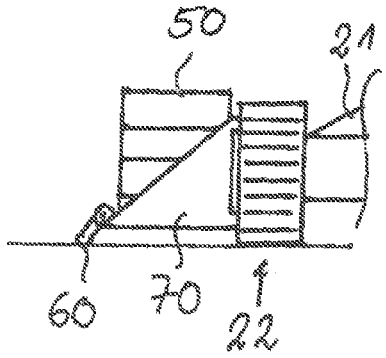
FIG. 6: a detail of the crawler carrier of an auxiliary crane with an installed reception frame.

FIG. 6 shows an alternative fastening option for the ballast plates 50 at the auxiliary crane 20. A crawler carrier 22 of auxiliary crane 20 can be seen from the detail of FIG. 6 and an additional reception frame 70 is bolted to its outer side via the existing connection points. Suitable ballast plates 50 can be stacked in a vertical direction on the horizontal surface of the reception frame 70. The reception frame 70 is likewise equipped with the aforesaid switch 60 which extends from the outer frame tip to the ground and determines the relative position of the auxiliary crane 20 in the vertical direction with respect to the ground.

Figure 7:
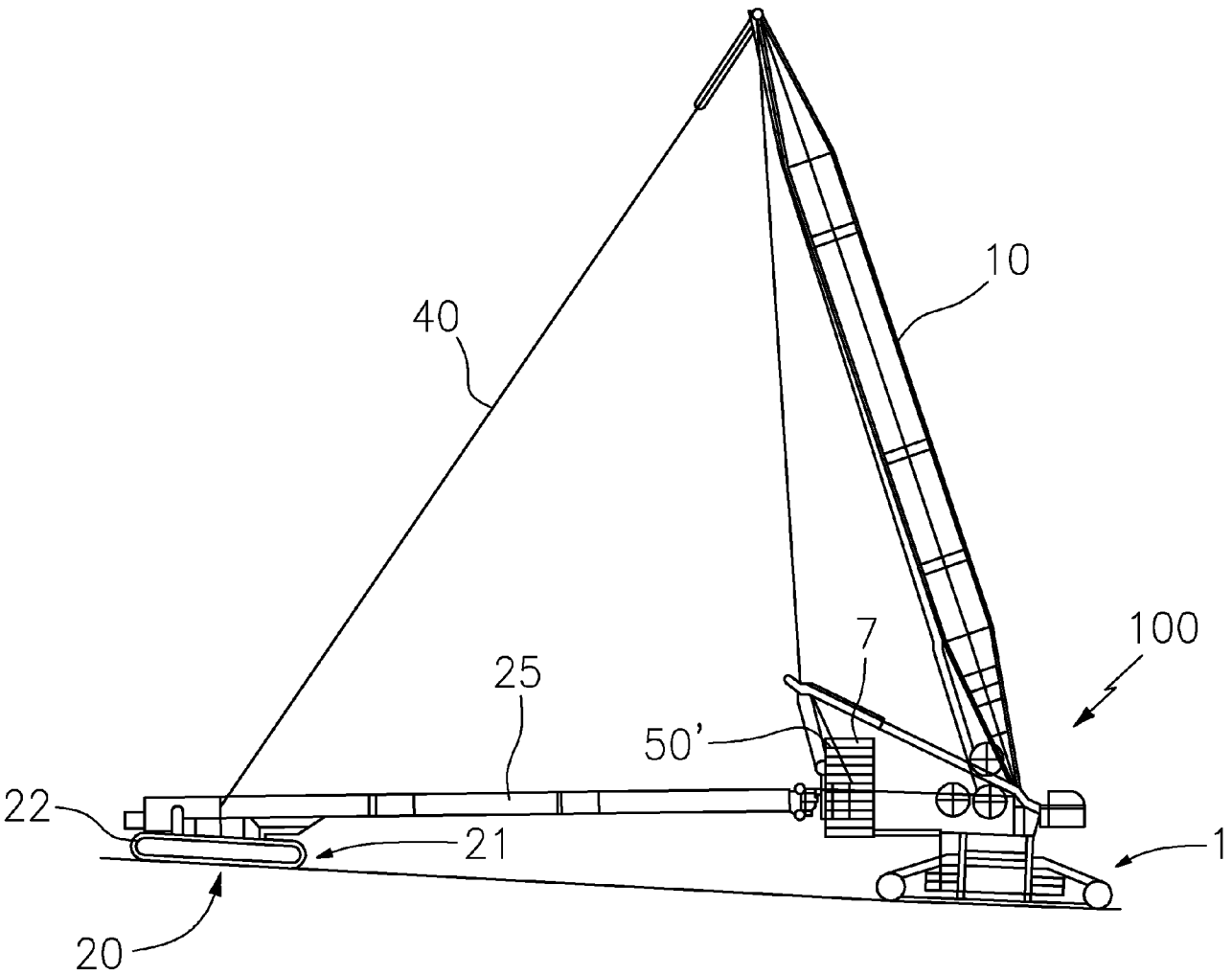
FIG. 7: a further side view of the crane in accordance with the invention with a fastened auxiliary crane.

FIG. 7 shows a further side view of the crane system comprising the main crane 100 and the auxiliary crane 20. The boom 25 of the auxiliary crane is connected to the crane 100 via its boom tip in this case. The especially designed ballast plates 50', which are predominantly used for the additional ballast application of the auxiliary crane 20 are alternatively slacked on the ballast receiver of the crane 100.

The invention claimed is:

1. A method of operating a crane (100) having a movable undercarriage (1) and a superstructure (4) rotatably supported thereon with a luffable main boom (5) and derrick boom (10) luffably arranged thereon, comprising the steps of moving an auxiliary crane (20) having a telescopic boom (25) into position in vicinity of the crane undercarriage (1) and superstructure (4), the telescopic boom (25) comprising a roller head (27) having bolting points (31, 32), arranging a non-telescoping adapter (30) directly between an end of the telescopic boom (25) and the superstructure (4), directly connecting the telescopic boom (25) through the non-telescoping adapter (30) to the rotatable superstructure (4) as derrick ballast by bolting connection points (36, 37) of the adapter (30) to the bolting points (31, 32) of the roller head (27) of the telescopic boom (25), fastening the adapter (30) to the superstructure (4) through connection points (34, 35) extending horizontally along an axis (33) when fastened to the superstructure (4), to provide a degree of freedom for compensating vertical differences between the main crane (100) and auxiliary crane (20), and setting a derrick ballast radius via telescoping of the telescopic boom (25) of the auxiliary crane (20).

2. A method in accordance with claim 1, wherein a crane control controls at least one drive of the auxiliary crane used as derrick ballast in dependence on travel movement of the crane.

3. A method in accordance with claim 2, wherein the crane control controls at least one drive of the auxiliary crane used as derrick ballast in dependence on rotational movement of the crane superstructure or on another crane movement.

4. A method in accordance with claim 1, wherein at least one guying is arranged between the derrick boom and the auxiliary crane.

5. A method in accordance with claim 4, wherein the guying is directly or indirectly connected via a frame to a superstructure (24) of the auxiliary crane.

6. A method in accordance with claim 4, wherein the guying is pivotally connected directly or indirectly to a pivotal connection piece of the boom of the auxiliary crane in a region of a luffing cylinder support or any outer section of the pivotal connection piece of the boom.

7. A method in accordance with claim 1, wherein the auxiliary crane is connected to the crane via the telescopic boom (25) thereof, with a boom tip of the auxiliary crane being directly or indirectly connected to at least one of the crane superstructure, a crane ballast receiver and the derrick boom.

8. A method in accordance with claim 1, wherein at least one or mare electric or hydraulic control lines are guided, starting from the crane, via the connection adapter to at least one drive of the auxiliary crane via at least one or more guide means and coupling points at the connection adapter.

9. A method in accordance with claim 1, wherein one or more ballast elements or ballast plates are arranged directly or indirectly at the auxiliary crane or at least one crawler carrier (22) thereof.

10. A method in accordance with claim 9, wherein one or more ballast elements or ballast plates are fastened directly or indirectly to the auxiliary crane via at least one additional reception frame.

11. A method in accordance with claim 1, wherein at least one measuring arrangement defines relative position of the auxiliary crane in vertical direction toward the ground and communicates a determined value to a crane control, with the crane control releasing a rotational movement of the auxiliary crane, if the auxiliary crane does not have any contact with the ground.

12. A method in accordance with claim 1, wherein at least one measuring arrangement determines length of a longitudinally variable connection line between the auxiliary crane and the crane or distance between a pivotal connection piece of the boom and a broom head of the auxiliary crane.

13. A method in accordance with claim 12, wherein a crane control sets the length of the connection line or extension length of the telescopic boom of the auxiliary crane, in dependence on measured relative position of the auxiliary crane in vertical direction.

14. A crane (100) having a movable undercarriage (1), a superstructure (4) rotatably supported thereon with a main boom (5) and derrick boom (10) arranged luffably thereon, an auxiliary crane (20) having a movable undercarriage (21), a superstructure (24) rotatably mounted thereon and a telescopic boom (25) telescopically mounted on the rotatable superstructure (24), and a separate non-telescopic adapter (30) configured to be directly connected to both the telescopic boom (25) and the superstructure (4), and through which the telescopic boom (25) is directly connected to the rotatable superstructure (4) of the crane (100), wherein the telescopic boom (25) of the auxiliary crane (20) comprises a roller head (27) having bolting points (31, 32), and the adapter (30) comprises connection points (36, 37) at an end thereof and arranged for bolting to the bolting points (31, 32) of the roller head (27) of the telescopic boom (25) of the auxiliary crane (20), and connection points (34, 35) disposed at an opposited end thereof along an axis (33) arranged to extend horizontally when fastened to the superstructure (4), to provide a degree of freedom for compensating vertical differences between the main crane (100) and auxiliary crane (20).

15. A crane in accordance with claim 14, wherein the interposed connection adapter has at least one or more guide means and coupling points for one or more electric or hydraulic control lines which serve the guiding or establishing of controlling connection between the crane and the auxiliary crane.

16. A crane in accordance with claim 14, additionally comprising ballast plates selectively arranged at the crane or the auxiliary crane for applying ballast.

17. A crane in accordance with claim 16, wherein the auxiliary crane has at least one of (i) a sensor or pivotable switch, for measuring position of the auxiliary crane in a vertical direction and (ii) a sensor or measuring drum by which length of a longitudinally variable connection line between the crane and the auxiliary crane is detected.

18. A crane in accordance with claim 16, wherein at least one reception frame is connected, connectable, bolted or boltable, to the auxiliary crane or at least one crawler carrier of the auxiliary crane, for receiving one or more ballast plates.

19. A crane in accordance with claim 14, wherein the adapter (30) is tapered with the connection points (36, 37) at a narrower end thereof arranged for bolting to the bolting points (31, 32) of the roller head (27) of the telescopic boom (25) of the auxiliary crane (20), and the connection points (34, 35) disposed at a wider end thereof arranged to extend horizontally along the axis (33) when fastened to the superstructure (4).

20. A crane in accordance with claim 14, wherein the undercarriage (24) comprises a crawler chassis (22) carrying two crawler tracks, and additionally comprising ballast plates (50) bolted to the crawler chassis (22) at each outer surface of the two crawler tracks, and at least one switch (60) provided at each ballast stack (50) and extending at a variable angle from a surface of the ballast stack (50) to a direction of a footprint of the auxiliary crane (20), such that if the auxiliary crane (20) loses contact with the ground, the switch (60) pivots out downwardly with the switch angle to the ballast stack (50) decreasing and a sensor system within the switch (60) reporting position to a crane control of the main crane (100) to allow rotational movement of the main crane (100) without controlling the auxiliary crane (20).

21. A crane in accordance with claim 14, wherein the undercarriage (24) comprises a crawler chassis (22) carrying two crawler tracks, and additionally comprising reception frames (70) bolted to outer surfaces of the two crawler tracks and arranged to receive ballast plates (50) stacked thereon, and at least one switch (60) provided at each reception frame (70) and extending at a variable angle from a surface of the reception frame (70) to a direction of a footprint of the auxiliary crane (20), such that if the auxiliary crane (20) loses contact with the ground, the switch (60) pivots out downwardly with the switch angle to the reception frame (70) decreasing and a sensor system within the switch (60) reporting position to a crane control of the main crane (100) to allow rotational movement of the main crane (100) without controlling the auxiliary crane (20).

22. A method of operating a crane (100) having a movable undercarriage (1) and a superstructure (4) rotatably supported thereon with a luffable main boom (5) and derrick boom (10) luffably arranged thereon, comprising the steps of moving an auxiliary crane (20) having a telescopic boom (25) into position in vicinity of the crane undercarriage (1) and superstructure (4), arranging a non-telescoping adapter (30) directly between an end of the telescopic boom (25) and the superstructure (4), directly connecting the telescopic boom (25) through the non-telescoping adapter (30) to the rotatable superstructure (4) as derrick ballast, setting a derrick ballast radius via telescoping of the telescopic boom (25) of the auxiliary crane (20), and guying (40) a tip of the derrick boom (10) to a rotatable superstructure (24) of the auxiliary crane (20), which is the only direct connection between the auxiliary crane (20) and the tip of the derrick boom (10).

23. A crane (100), comprising a movable undercarriage (1), a superstructure (4) rotatably supported thereon with a main boom (5) and derrick boom (10) arranged luffably thereon, an auxiliary crane (20) having a movable undercarriage (21), a superstructure (24) rotatably mounted thereon and a boom (25) telescopically mounted on the rotatable superstructure (24), a separate non-telescopic adapter (30) configured to be directly connected to both the telescopic boom (25) and the superstructure (4), and through which the telescopic boom (25) is directly connected to the rotatable superstructure (4) of the crane (100), and guying (40) interconnecting the rotatable superstructure (24) of the auxiliary crane (20) to a tip of the derrick boom (10) which is the only direct connection between the auxiliary crane (20) and the tip of the derrick boom (10).

* * * * *